United States Patent [19]

Eston

[11] Patent Number: 4,603,493

[45] Date of Patent: Aug. 5, 1986

[54] INSOLE WITH MOLDABLE MATERIAL

[76] Inventor: Gary A. Eston, 352 Bofin, Foster City, Calif. 94404

[21] Appl. No.: 653,569

[22] Filed: Sep. 24, 1984

[51] Int. Cl.[4] ..... A43B 13/40

[52] U.S. Cl. ..... 36/44; 36/28

[58] Field of Search ..... 36/43, 44, 28, 29, 30 R, 36/88, 93

[56] References Cited

U.S. PATENT DOCUMENTS

| | | | |
|---|---|---|---|
| 89,105 | 4/1869 | Williams | 36/44 |
| 2,760,281 | 8/1956 | Cosin | 36/44 X |
| 3,398,469 | 8/1968 | Bressan | 36/44 X |
| 3,724,106 | 4/1973 | Magidson | 36/44 |
| 3,871,117 | 3/1975 | Richmond et al. | 36/43 |
| 3,892,077 | 7/1975 | Wolstenholme et al. | 36/44 |
| 3,922,801 | 12/1975 | Zente | 36/44 |
| 3,968,577 | 7/1976 | Jackson | 36/43 |
| 4,017,931 | 4/1977 | Golden | 36/44 X |
| 4,115,934 | 9/1978 | Hall | 36/44 |
| 4,123,855 | 11/1978 | Thedford | 36/44 |

*Primary Examiner*—Henry Jaudon
*Assistant Examiner*—T. Graveline
*Attorney, Agent, or Firm*—Julian Caplan

[57] ABSTRACT

An insole for use as a replacement insole or for permanent installation in a shoe or other item of footwear is of sandwiched construction with a flexible, moldable non-setting material inside, so that the upper surface of the insole molds and conforms to the bottom of the foot of the wearer. The insole is glued together, with an overlap of the top innersole piece folded under and adhered to the bottom of an upper subsole or shoe board immediately below. In specific areas at the tips of the toes and the heel, there is stitching through the thickness of the insole, spaced inwardly a short distance from the edge of the insole, to prevent excessive flow of the moldable material and consequent bottoming out of the foot in these areas.

14 Claims, 7 Drawing Figures

INSOLE WITH MOLDABLE MATERIAL

BACKGROUND OF THE INVENTION

The invention relates to footwear, and more particularly to an insole for a shoe or other item of footwear, containing a moldable, flowable material for conforming to the bottom of the foot of the wearer for greater comfort.

An article of footwear incorporating an insole member having flexible, moldable material for conforming to the user's foot is disclosed in Jackson U.S. Pat. No. 3,968,577. That patent discloses the use of formable, nonsetting silicone material in an enclosure or "casting unit" of the footwear, injected therein either at the time the footwear is purchased, or incorporated in the footwear during manufacture.

While the system of the Jackson patent did function effectively to form an impression of the foot and conform to the contours of the foot for greater comfort, the structure disclosed therein was not useful or adaptable as a replacement insole for shoes or other items of footwear. Moreover, the patent did not address some particular considerations and problems addressed by the present invention, regarding both replacement insoles and insoles permanently secured in footwear. These considerations include flow of the formable material and maintaining of a required thickness of the material in critical areas where the user's concentrated weight would otherwise tend to force all the moldable material out of the particular area, causing that portion of the foot to bottom out.

Neither the Jackson patent nor any other insole or replacement insole in the prior art was capable of providing the continued comfort and reliable, therapeutic support of the present invention described below.

SUMMARY OF THE INVENTION

An insole according to the present invention includes a relatively stiff base subsole as a bottom member, having an outlining shape conforming generally to that of the interior of the footwear and flexible enough to bend with the footwear. A flexible upper subsole is positioned above the base subsole, and a soft, flexible innersole piece is positioned above the upper subsole as the top surface of the insole. There is positioned between the upper subsole and the innersole piece a mass of flexible, moldable, nonsetting material, for causing the innersole piece to conform to the bottom of the foot of a wearer of the footwear.

An important feature of the invention is the means for securing the base subsole, the upper subsole and the innersole piece together so as to contain and seal the nonsetting material. This comprises an overlap of the innersole piece over the upper subsole around its periphery, with the overlap tucked under the upper subsole and glued to its underside. The base subsole is glued to the bottom of the upper subsole and the innersole overlap. There is stitching in certain important locations, through all three layers of the innersole, the upper subsole and the base subsole, and spaced inward a short distance from the edge of the insole. In one location the stitching is in an arc at the front of the wearer's first toe. The other location of the stitching is a generally arcuate pattern at the heel. These areas of stitching prevent the moldable, nonsetting material from excessive molding and migration beyond the stitching in those locations, thereby preventing squeezing of all moldable material from any one spot, or bottoming out.

It is important that the innersole piece be free of stitching in certain locations, i.e. at the forefoot on either side of the ball of the foot, and at the cuboid bone at the outer mid-foot back to just forward of the heel. In these locations, it is important that the nonsetting material be allowed to mold and flow out the periphery of the insole, for full support of the foot, and for avoiding the lumps that would be felt by the user if there were stitching in these areas.

In a preferred embodiment, the heel stitching extends through at least a semicircular arc. All stitching preferably is spaced inwardly about 3/16 inch to about ¼ inch from the edge of the insole.

In another preferred embodiment, there is included a flexible foam arch insert pad at the medial arch, glued into position between the base subsole and the bottom of the upper subsole with the innersole overlap adhered thereto.

The invention also encompasses an insole as permanently attached in a shoe or other article of footwear, in which case the insole does not include both an upper subsole and a base subsole, but only a single subsole over which the innersole piece is attached, and which is glued down into the shoe.

It is therefore among the objects of the invention to provide an improved insole of a sandwiched-together construction including a moldable, flowable material which allows dynamic molding to the feet and greatly enhanced comfort and therapeutic benefits to the foot, and which in one embodiment is an almost universally usable replacement insole for insertion in a footwear article to replace the existing insole. These and other objects, advantages, features and characteristics of the invention will be apparent from the following description of a preferred embodiment, considered along with the accompanying drawings.

DESCRIPTION OF PREFERRED EMBODIMENTS

Figure 1:
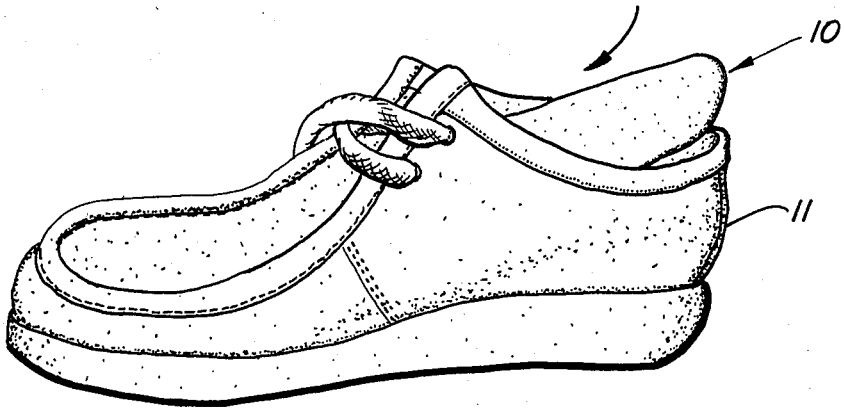
FIG. 1 is a partially broken away perspective view showing a shoe with a replacement insole according to the invention.

In the drawings, FIG. 1 shows a replacement insole 10 according to the invention, inserted into a shoe 11 or other article of footwear. The insole 10 of the invention can be placed in almost any item of footwear, particularly those having a removable insole, as do most shoes. It can also be used in shoes with non-removable insoles, provided the shoes are purchased slightly large.

Figure 2:
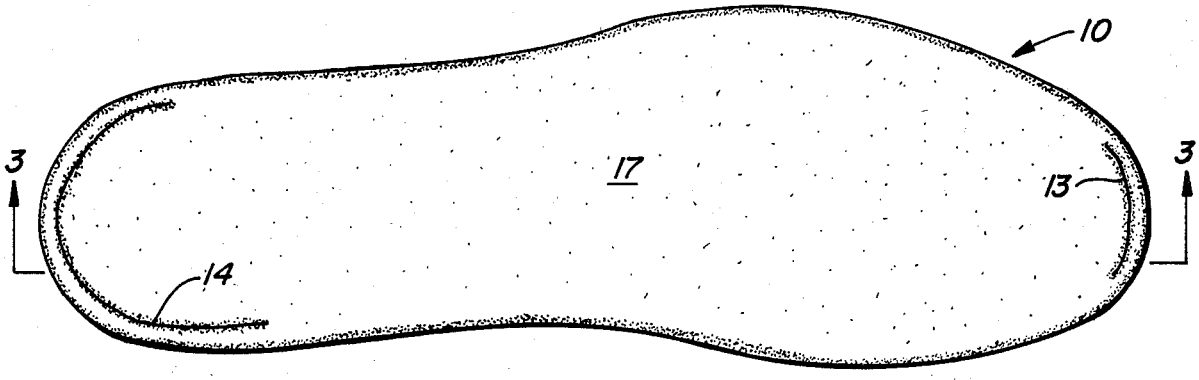
FIG. 2 is a top plan view of the replacement insole.

FIG. 2 shows the top of the insole 10, in particular illustrating toe and heel stitching 13 and 14 respectively, which passes through the entire thickness of the insole and serves an important function, as will be further explained below.

Figure 3:
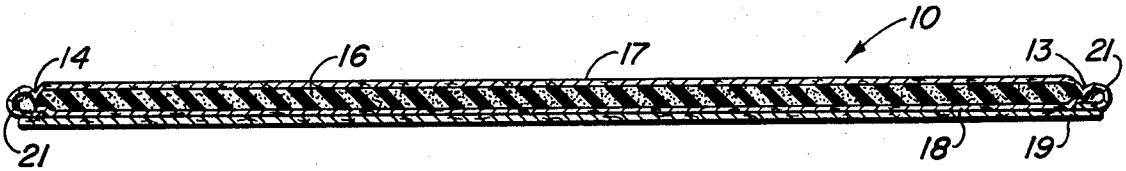
FIG. 3 is a fragmented elevational section view of the insole of FIG. 2, taken along the line 3—3 of FIG. 2.

As shown in the sectional view of FIG. 3, the replacement insole 10 includes a mass of flexible, moldable, nonsetting material 16, which may be as disclosed in the Jackson patent cited above, contained between an innersole piece 17 which forms the upper surface of the insole and a flexible upper subsole or shoe board 18 below. A base subsole 19 (also sometimes known as a shoe board) preferably is included below the upper subsole 18, the base being of a relatively stiffer but still flexible material, such as a relatively heavy leather.

The moldable nonsetting material 16 is contained between the innersole piece 17 and upper subsole 18 primarily by the gluing of an overlap portion 21 of the innersole piece to the underside of the upper subsole 18 at its periphery. The glued connection preferably is continuous around the entire periphery of the insole 10. However, in specific areas it is important that the stitching 13 and 14 be included. Specifically, the stitching 13 is at the front of the first toe or the first and second toes of the wearer, the first and second toe positions 22 and 23 being generally indicated by shading in the used and form-fitted insole 10 shown in FIG. 4. The stitching 13, as well as the stitching 14, is in a generally arcuate configuration and should be spaced inward from the edge 24 of the insole by about 3/16 inch to about ¼ inch. The generally arcuate stitching 13 extends through approximately a quarter circle or less, with a minimum length of about 1¼ inches. The maximum length of the stitching may be about 2½ inches. The stitching may extend from an end 13*a* approximately at the edge of the toenail of the first toe at the inner side of the insole, to an end 13*b* at the outer side of the insole, near the second toe.

The importance of the stitching at the toe of the insole is to contain the moldable material from excessive flowing in this area, particularly because there are dynamic thrust forces in this area at the front of the foot, especially if the insoles are used in athletics. These forces tend to move the material excessively to the point that it might bottom out at critical points if there were not additional containment provided by the stitching. The stitching dams up and traps the silicone material, which might otherwise flow forward to the point of building up at the forward edge of the insole, in front of the bearing area for the toes where it is needed. The stitching 13 is essentially in front of the main bearing area of the toes, so that the toes do not feel the stitches or any lumpiness associated with material buildup at the stitching.

The stitching 13 also helps hold the insole together in this area where there is a great deal of thrust and stress.

On the other hand, it is important that there be no stitching in certain areas. One area is at the outer or lateral side of the insole, through the contact area of the cuboid bone, i.e. approximately from the point 26 indicated in FIG. 4, which is behind the base of the small toe, back to just forward of the heel, approximately at the point 27 shown in FIG. 4. The reason is that in this area, the full width of the insole 10 is needed for the support of the user at the outer side of the foot, since the user's weight is often spread out to very near the outer edge of the insole. The moldable material must be allowed to flow properly for the entire width of the foot. If there were stitching in this area, the wearer would feel a lumpiness.

Figure 4:
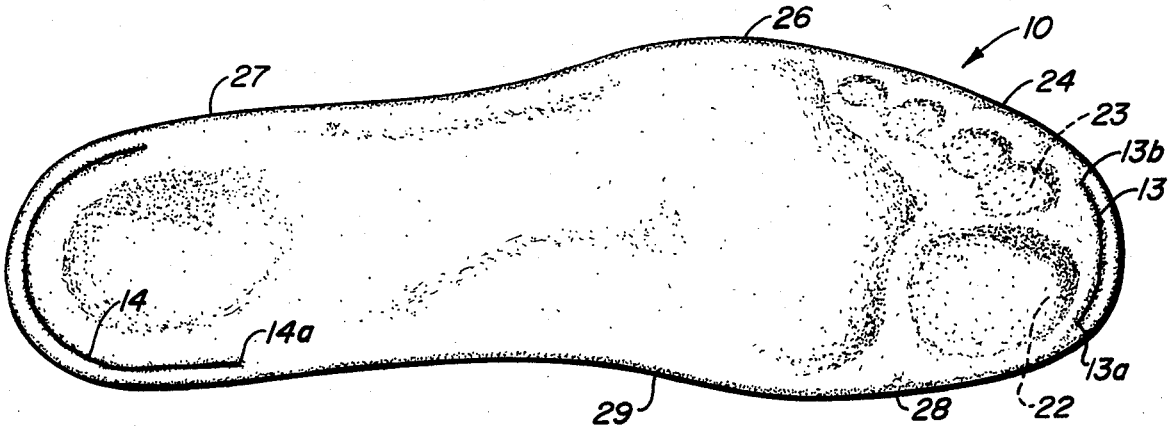
FIG. 4 is a top plan view of the replacement insole of FIG. 2, after it has been worn in an article of footwear and has molded to conform to the bottom of the foot of the wearer.

It is also important that stitching be avoided at the inner or medial side of the insole 10, from approximately the base of the first toe, i.e. approximately from the point 28 on FIG. 4, back through the forefoot area, to approximately the point 29 on FIG. 4 at the front of the arch area. This is because again, the user often bears on the insole out to the edge. If stitching were included here, or in the cuboid bone area on the other side, the moldable material would build up and form a lump perceptable and uncomfortable to the user.

The heel stitching 14 is also in a generally arcuate configuration around the heel area, spaced inwardly from the insole edge similarly to the toe stitching 13. Preferably, this stitching 14 extends through at least a semicircular configuration, and preferably somewhat forward at the inner stitching end 14*a*. At the heel, considerable weight is concentrated, and the stitching is needed to confine the pliable material to prevent bottoming out at the center bearing area of the heel. The outside end 14*b* of the stitching is close to the forward end of the heel bone, slightly ahead of where the center of the heel bone lies and forms the deepest depression of the moldable material. At the inner end 14*a*, the stitching extends about an inch ahead of the center of the heel bone, as shown in FIG. 4. Generally, the stitching extends farther at the inner end 14*a* because extra support for the pliable material is needed here in the event the wearer pronates, or tilts his heel inward, in walking or running, as many do. Containment is needed to prevent the pronation from moving the material excessively away from the needed support area.

As can be seen from FIG. 4, the heel stitching 14 is outside the main bearing area of the heel and is not felt by the wearer of the footwear.

The base subsole 19 may be of a relatively stiff leather or suede leather material or other suitable composite material, still flexible enough to bend with the article of footwear, and it preferably is glued to the bottom of the upper subsole 18 and the tucked-under overlap 21 of the innersole piece 17. Generally, the relatively stiff base 19 is needed as a backing to assure the maintenance of the replacement insole's shape, and to provide a good backing for receiving the stitching 13 and 14. However, in some cases the base 19 can be eliminated, or the upper subsole 18 can be eliminated, with only one shoe board around which the innersole piece 17 is wrapped. Thus, two layers of material can be sufficient for forming the shape of the insole and containing the flexible, moldable material 16 inside.

Figure 5:
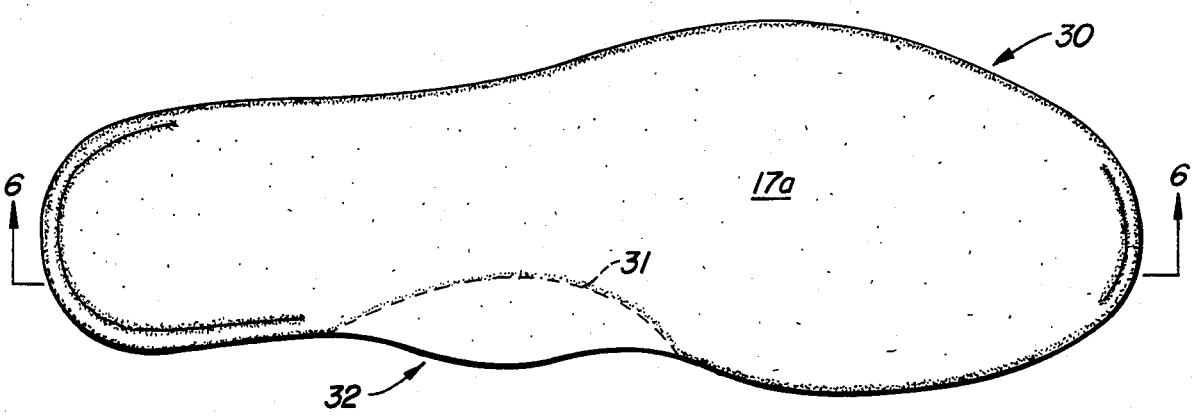
FIG. 5 is a top plan view of another form of replacement insole according to the invention, including a medial arch pad.
Figure 6:
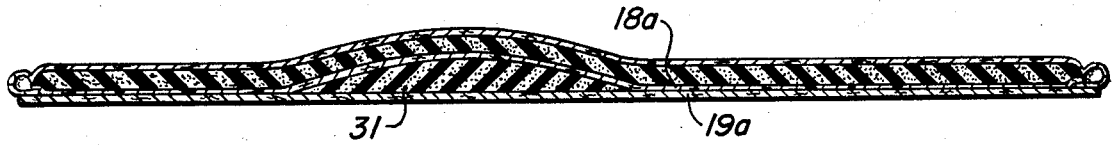
FIG. 6 is a fragmented elevational section view of the insole of FIG. 5, taken along the line 6—6 of FIG. 5.

FIGS. 5 and 6 show a modified form of replacement insole 30 according to the invention, including a medial arch pad or insert 31 as shown in the sectional view of FIG. 6 and also indicated in FIG. 5. As is well known, such an arch insert is often needed for therapeutic reasons for many persons. In the scaphoid arch area 32, the insole preferably extends outwardly with a slight convexity, as compared to the generally concave shape of the insole 10 described above.

The arch insert 31 preferably is glued to the base subsole 19*a* and to the upper subsole 18*a* (and to the overlapping edge of the innersole piece 17*a* above), holding it securely in place. The arch insert 31 may be uncovered and exposed at the inner side of the insole 30, where its depth is the greatest.

Figure 7:
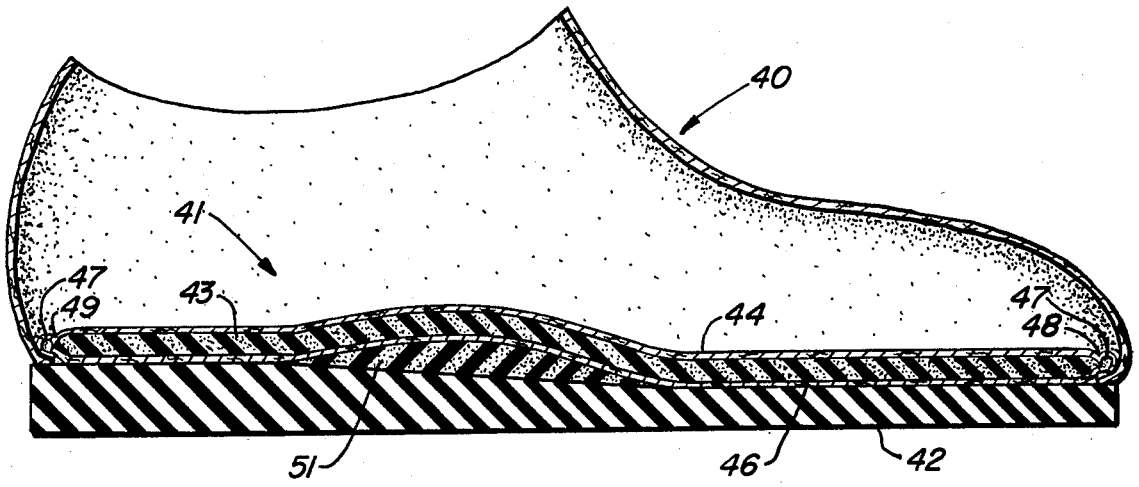
FIG. 7 is an elevational section view of a shoe having an insole according to the invention permanently secured therein.

FIG. 7 shows in sectional view a shoe 40 including a built-in insole 41, preferably attached by gluing to the shoe's sole 42. In this permanently secured form of insole 41 there is no need for both a base and an upper subsole as shown in the previous embodiments, and instead the mass of pliable, moldable material 43 is retained between a soft innersole piece 44 and a show board 46 below, with the innersole piece having a tucked-under overlap 47 of the innersole piece glued to the bottom of the shoe board 46. Since the insole 41 is glued to the sole 42 of the shoe, no base piece is required on the insole, either for stability or for cosmetic purposes, as it was for the replacement insoles described above.

Stitching 48 and 49 at the toe and heel of the insole 41 is similar to that shown and described with respect to the replacement insoles 10 and 30 above. The insole 41 usually includes a medial arch insert 51, which is simply glued to the bottom of the shoe board 46 prior to the insertion of the insole 41 into the shoe 40.

In the manufacture of the insoles 10, 30 and 41, the moldable material 16 or 43 is placed as a pre-cut sheet on top of the pre-cut shoe board below. The sheet of moldable material is sized slightly smaller than the shoe board, by about $\frac{1}{8}$ inch to 3/16 inch all around its periphery. This makes wrapping of the innersole piece 17, 17*a* or 44, and the gluing of the overlap under the shoe board, more efficiently accomplished, and it also helps cause proper flowing of the moldable material when the insole is in use. Also, in the areas where stitching is used, it generally enables the moldable material to be contained behind the stitching, substantially keeping the moldable material out of the space between the stitching and the outer periphery of the innersole piece.

After the innersole piece has been wrapped around and its overlap glued under the shoe board, and the stitching has been accomplished, the medial arch pad is added by gluing to the underside of the shoe board, when an arch pad is required. Then the insole so constructed may either be used as a replacement insole, or glued into a shoe 40 as in FIG. 7. In the case of a replacement insole as shown in FIGS. 1–6, a further shoe board or base subsole 19 or 19*a* is glued to the bottom of the upper shoe board, preferably prior to stitching, for increased stability and better appearance of the removable insole.

The preferred embodiment described herein is intended to be purely illustrative, and not limiting of the scope of the invention. Other embodiments and variations will be apparent to those skilled in the art and may be made without departing from the essence and scope of the invention as defined in the following claims.

I claim:

1. An insole for an item of footwear having a medial and a lateral side and comprising:

a shoeboard having a profile which generally conforms to the outline of the foot of a wearer and flexible to bend with the footwear item;

a soft, flexible innersole piece above the shoe board;

a mass of flexible, moldable, nonsetting material contained between the shoe board and the innersole piece, for causing the innersole piece to conform to the bottom of the foot of a wearer of the footwear;

connection means for securing the shoe board and the innersole piece together so as to contain and seal the nonsetting material between them, comprising an overlap of the innersole piece over the shoe board around its periphery, the overlap being tucked under the shoe board and glued to the underside thereof, and stitching from the innersole down through the shoe board, the stitching being inward a short distance from the edge of the insole and being in one general arc in front of the wearer's first toe and in another generally arcuate pattern at the heel, thereby preventing the moldable nonsetting material from excessive molding and migration beyond the stitching in those locations;

the innersole piece being free of stitching at the forefoot on either side of the ball of the foot, and at the cuboid bone at the lateral midfoot back to just forward of the heel, whereby the nonsetting material is allowed to mold and flow out to the periphery of the insole in these areas.

2. The insole of claim 1, wherein the stitching at the heel extends through at least a generally semicircular configuration.

3. The insole of claim 1, wherein the stitching at the heel extends from just forward of the center of the heel bone of the wearer's foot at the lateral side of the insole, through a generally semicircular configuration and farther forward at the medial side of the insole to about one inch ahead of the center of the heel bone.

4. The insole of claim 1, wherein the stitching is spaced about 3/16 inch to about $\frac{1}{4}$ inch inward from the edge of the insole.

5. The insole of claim 1, wherein the arc of stitching at the toe extends through about $1\frac{1}{2}$ inches.

6. The insole of claim 1, wherein the insole includes a medial arch pad, glued to the underside of the shoe board.

7. The insole of claim 1, wherein the insole is permanently affixed in the item of footwear, with the shoe board glued down to the sole of the footwear.

8. The insole of claim 1, further including a relatively stiff base subsole glued to the underside of the shoe board for increased stability of the insole as a replacement insole, the stitching passing through the innersole piece, the shoe board and the base subsole.

9. An insole for placement in an item of footwear to replace an existing insole, said insole having a medial side and a lateral side, comprising:

a relatively stiff base subsole or shoe board as a bottom for the insole, having a profile which generally conforms to the outline of the foot of a wearer and flexible to bend with the footwear item;

a flexible upper subsole or upper shoe board above the base subsole;

a soft, flexible innersole piece above the upper subsole;

a mass of flexible, moldlable, nonsetting material contained between the upper subsole and the innersole piece, for causing the innersole piece to conform to the bottom of the foot of a wearer of the footwear;

connection means for securing the base subsole, the upper subsole and the innersole piece together so as to contain and seal the nonsetting material between the upper subsole and the innersole piece, comprising an overlap of the innersole piece over the upper subsole around its periphery, the overlap being tucked under the upper subsole and glued to the underside thereof, and the base subsole being glued to the upper subsole and the innersole overlap, and stitching from the innersole piece down through the upper subsole and the base subsole, the stitching being inward a short distance from the edge and parallel to the profile of the insole and being only in two areas, a first said area being at the toe and being in one general arc in front of at least the wearer's first toe and a second said area being at the heel in a generally arcuate pattern at the heel, thereby preventing the moldable nonsetting material from excessive molding and migration beyond the stitching in those locations;

the innersole piece being free of stitching at the forefoot on either side of the ball of the foot, and at the cuboid bone at the lateral midfoot of a wearer back to just forward of the heel, whereby the nonsetting material is allowed to mold and flow out to the periphery of the insole in these areas.

10. The insole of claim 9, wherein the stitching at said second area extends through at least a generally semicircular configuration.

11. The insole of claim 9, wherein the stitching at said second area extends from just forward of the center of the heel bone of a wearer at the lateral side of the insole, through a generally semicircular configuration and farther forward at the medial side of the insole to about one inch ahead of the center of the heel bone of a wearer.

12. The insole of claim 9, wherein the stitching is spaced about 3/16 inch to about $\frac{1}{4}$ inch inward from the edge of the insole.

13. The insole of claim 9, wherein the arc of stitching at the toe is between about $1\frac{1}{4}$ inches and about $2\frac{1}{2}$ inches in length.

14. The insole of claim 9, wherein the mass of nonsetting material is in a sheet cut somewhat smaller than the upper shoe board, such that it is spaced inwardly a short distance from the edge of the shoe board.

* * * * *